US007444690B2

(12) United States Patent
Holland

(10) Patent No.: US 7,444,690 B2
(45) Date of Patent: Nov. 4, 2008

(54) SITZ BATH FOR TREATING HEMORRHOIDS

(76) Inventor: Marilyn Holland, 66 Harwood Rd., Monroe Township, NJ (US) 08831

( * ) Notice: Subject to any disclaimer, the term of this patent is extended or adjusted under 35 U.S.C. 154(b) by 370 days.

(21) Appl. No.: 11/182,420

(22) Filed: Jul. 15, 2005

(65) Prior Publication Data

US 2007/0011802 A1 Jan. 18, 2007

(51) Int. Cl.
*A47K 3/022* (2006.01)

(52) U.S. Cl. ..... 4/445; 4/446

(58) Field of Classification Search ..... 4/445, 4/446, 474.1, 541.1, 541.5, 545, 621, 622; 601/16, 17, 22, 158, 160, 162
See application file for complete search history.

(56) References Cited

U.S. PATENT DOCUMENTS 3,039,117 A * 6/1962 Hoskins ..... 4/444
3,072,918 A * 1/1963 McCall et al. ..... 4/445
4,764,997 A * 8/1988 Anderson et al. ..... 4/420.3
6,438,768 B1 * 8/2002 Yen ..... 4/622
6,505,358 B2 * 1/2003 Ferber et al. ..... 4/622
2005/0204467 A1 * 9/2005 Bean et al. ..... 4/622

* cited by examiner

*Primary Examiner*—Huyen Le
(74) *Attorney, Agent, or Firm*—Ezra Sutton

(57) ABSTRACT

A portable, heated bath container adapted for mounting on the top ledge of a toilet bowl for the treatment of hemorrhoids. The bath container is shaped to fit within a toilet bowl opening and has a bathing area for receiving water therein. The bath container includes an upper ledge surrounding the bathing area for resting on the top ledge of the toilet bowl. Further, the bath container includes an inner shell and an outer shell for forming an interior compartment between the inner and outer shells. The interior compartment has a plurality of spaced-apart heating elements disposed therein for maintaining the water in the bath container at a warm temperature. The interior compartment also houses one or more batteries for supplying power to the heating elements. Additionally, the bath container includes a power switch connected to the heating elements and batteries for turning power on and off to the heating elements. The bath container also includes a temperature control switch connected to the heating elements for regulating the temperature of the heating elements and the water in the bath container.

19 Claims, 5 Drawing Sheets

SITZ BATH FOR TREATING HEMORRHOIDS

FIELD OF INVENTION

The present invention relates to an improved sitz bath basin being adapted for mounting on the top ledge of a toilet bowl for the treatment and healing of hemorrhoids of a patient. More particularly, the sitz bath basin includes an interior compartment between inner and outer shells having heating coil elements therebetween for heating of water within a basin bathing area.

BACKGROUND OF THE INVENTION

Sitz bath/basins are well known in the prior art. Typically, a sitz bath/basin refers to a small, portable basin that fits on a toilet bowl. When taking a sitz bath, the lower abdominal, hips, genital area and buttocks are submerged in water, but the upper part of the user's body and the user's legs are raised out of the water. This particular type of bath is used to help increase the blood flow to the pelvic area of the user. A sitz bath is normally taken for about 20 to 30 minutes and hot water is normally added to the sitz basin to maintain the temperature. Typically, a hot sitz bath is taken in warm water between 95° F. to 105° F. (35° C. to 41° C.), with the water level not higher than the user's navel.

The sitz bath is beneficial to the user in order to relieve pain, itching, muscle spasms and cramps, hemorrhoids, anal fissures, painful testicles, inflammatory bowel distress, painful ovaries, uterine cramps, and/or prostate problems. The sitz bath is also used to aid in healing or for personal hygienic purposes. The sitz bath is usually recommended to soothe patient wound areas and to promote healing after hemorrhoid surgery or an episiotomy from childbirth. The warm water may include medication therein to further help and promote healing to the user. Sitz baths pose almost no risks, but on rare occasions patients can feel dizzy or experience rapid heart beat because of blood vessel dilation. Typical results in using a sitz bath is that the patient's affected area of swelling decreases; discomfort and/or pain is eased; and healing is promoted.

Accordingly, there remains a need for a sitz bath basin that maintains the water contained within the bathing compartment area at a warm and effective temperature. The sitz bath basin should include a heating device and a temperature control switch connected to the heating device for regulating the temperature (Tw) of the water being heated within the bathing compartment area of the sitz bath basin. Further, the sitz bath basin should include an interior compartment having inner and outer shells for housing the heating device. Also, there should be heat transfer $\Delta T$ from the heating device to the water to maintain it at a warm temperature.

DESCRIPTION OF THE PRIOR ART

Sitz baths, bidet devices, hot tub devices and the like having various designs, configurations, structures and materials of construction have been disclosed in the prior art. For example, U.S. Pat. No. 5,987,659 to CANNIZZARO discloses a bidet device providing repeatable solution treatments. This prior art patent does not disclose or teach the design, configuration and structure of the sitz bath/basin and method of use of the present invention.

U.S. Pat. No. 5,682,626 to BANKS, JR. et al. discloses an invalid bath chair with a therapeutic whirlpool. The bath chair includes an open seat having a hydro pad supported thereunder for creating a therapeutic whirlpool effect. The bath chair is utilized in a bathtub for treatment of perineal and perineal illnesses. This prior art patent does not disclose or teach the design, configuration and structure of the sitz bath/basin and method of use of the present invention.

None of the aforementioned prior art patents disclose a portable, lightweight, self-contained heated sitz bath/basin adapted for mounting on the top ledge of a toilet bowl for the treatment and healing of hemorrhoids of a patient.

Accordingly, it is an object of the present invention to provide a heated sitz bath/basin for the treatment and healing of hemorrhoids of a patient being adapted for mounting on the top ledge/rim of a toilet bowl opening of a toilet bowl.

Another object of the present invention is to provide a sitz bath/basin that includes an interior compartment between inner and outer shells having heating coil elements therebetween for heating of the water within the basin bathing area.

Another object of the present invention is to provide a sitz bath/basin that includes an interior compartment having a heat transferring liquid media such as silicone, glycol, oil and the like for transferring of heat $\Delta T$ from the heating coil elements to the inner shell of the sitz bath/basin and to warm the water contained therein.

Another object of the present invention is to provide a sitz bath/basin that includes an inner shell made from a thermally conductive plastic material, such that the heat transferring liquid media will conduct the heat transfer $\Delta T$ from the heating coil elements through the thermally conductive plastic material of the inner shell in order to maintain the temperature of the bath water at a warm and effective temperature for bathing of the user's buttock area in order to promote hemorrhoid healing.

Another object of the present invention is to provide a sitz bath/basin that includes an outer shell made from a non-conductive plastic material, such that the heat transferring liquid media will not transfer or conduct the heat transfer $\Delta T$ from the heating coil elements through the non-conductive plastic material of the outer shell, such that the temperature of the heat transferring liquid media will be maintained within the interior compartment of the sitz basin.

Another object of the present invention is to provide a sitz bath/basin that includes a power control switch and a temperature control knob being electrically connected to the heating coil elements for regulating the temperature of the heat transferring liquid within the interior compartment, as well as the temperature of the water within the sitz basin bathing area of the sitz bath/basin.

Another object of the present invention is to provide a sitz bath/basin that includes a plug inlet receptacle for receiving an electrical recharger assembly for re-charging of rechargeable batteries or disposable batteries within a watertight battery pack.

Another object of the present invention is to provide a sitz bath/basin that is made from lightweight, durable plastic materials or metal materials.

A further object of the present invention is to provide a sitz bath/basin that can be mass-produced in an automated and economical manner and is readily affordable by the patient.

SUMMARY OF THE INVENTION

In accordance with the present invention, there is provided a portable, heated bath container adapted for mounting on the top ledge of a toilet bowl for the treatment of hemorrhoids and other disorders. The bath container is shaped to fit within a toilet bowl opening and has a bathing area for receiving water therein. The bath container includes an upper ledge surrounding the bathing area for resting on the top ledge of the toilet bowl. Further, the bath container includes an inner shell and an outer shell for forming an interior compartment between the inner and outer shells. The interior compartment has a plurality of spaced-apart heating elements disposed therein for maintaining the water in the bath container at a warm temperature. The interior compartment also houses one or more batteries for supplying power to the heating elements. Additionally, the bath container includes a power switch connected to the heating elements and batteries for turning power on and off to the heating elements. The bath container also includes a temperature control switch connected to the heating elements for regulating the temperature of the heating elements and the water in the bath container.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
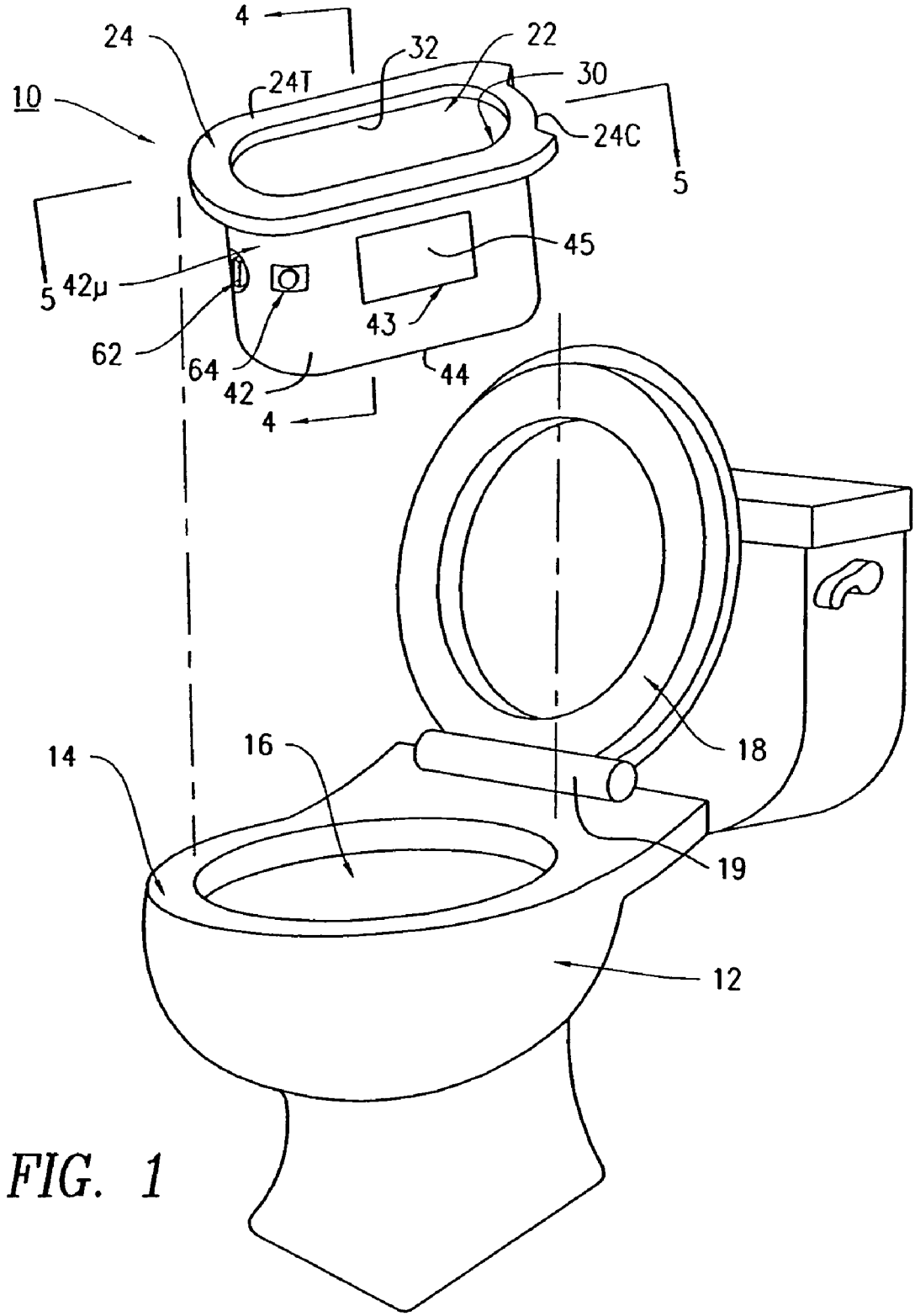
FIG. 1 is a perspective view of the sitz bath/basin of the preferred embodiment of the present invention showing the sitz bath basin being inserted into a toilet bowl opening and mounted on the rim of a toilet bowl.

The portable, heated sitz bath container/basin 10 and its component parts of the preferred embodiment of the present invention are represented in detail by FIGS. 1 through 7 of the patent drawings. The heated bath basin or container 10 is used for the treatment of hemorrhoids and other disorders, such that the bath container is adapted for mounting on a top ledge 14 and within a toilet bowl opening 16 of a toilet bowl 12. The sitz bath container basin 10 is shaped to fit within the toilet bowl opening 16 and has a substantially oval-shaped configuration.

Figure 2:
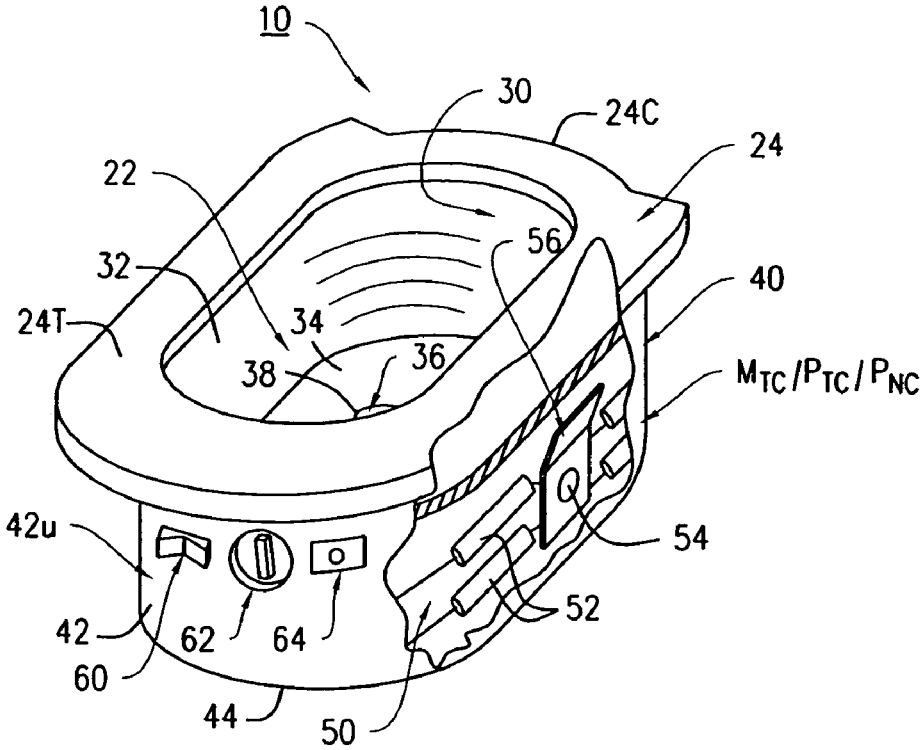
FIG. 2 is a perspective view of the sitz bath/basin of the present invention showing all of the major component parts of the basin.
Figure 3:
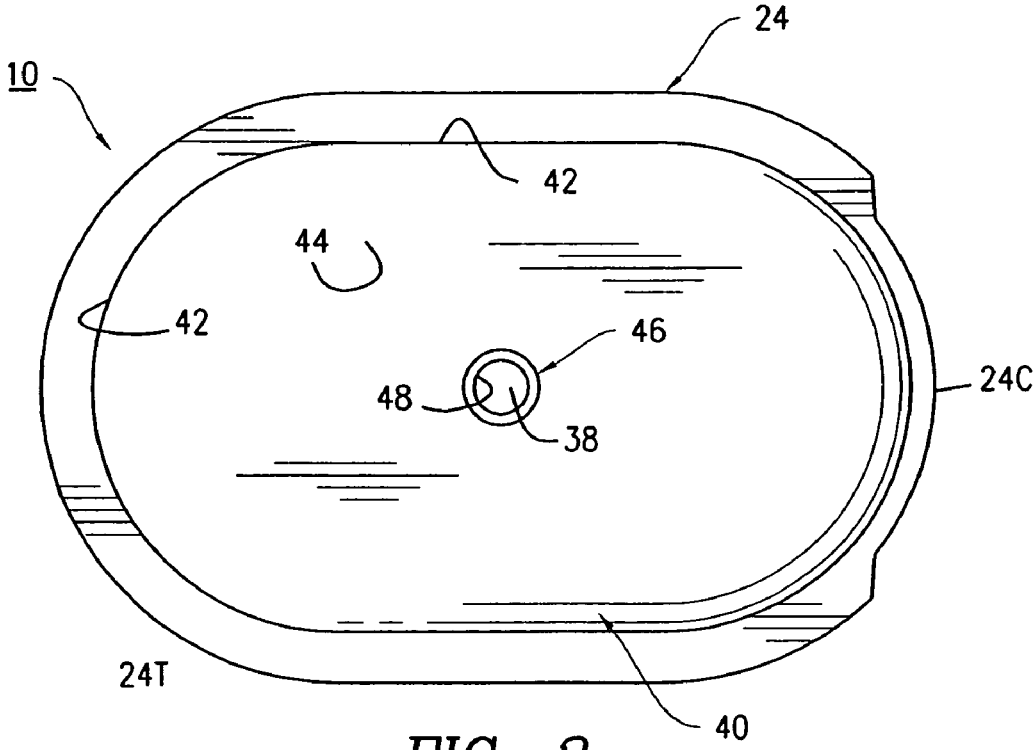
FIG. 3 is a bottom plan view of the sitz bath/basin of the present invention showing a drain opening and plug on a bottom wall of an outer shell of the basin.

The heated sitz bath container/basin 10, as shown in FIGS. 1 and 2, includes a bathing compartment area 22 for receiving water 20 therein. The bath container 10 includes an upper ledge 24 that surrounds the bathing compartment area 22 wherein the upper ledge 24 is used for resting on the top ledge or rim 14 of the toilet bowl 12. The upper ledge 24 also prevents any of the heated water 20 from splashing out when being used. The upper ledge 24 has an upper ledge section 24T for mounting on the rim 14 of the toilet bowl 12, as shown in FIG. 2 of the drawings.

Figure 4:
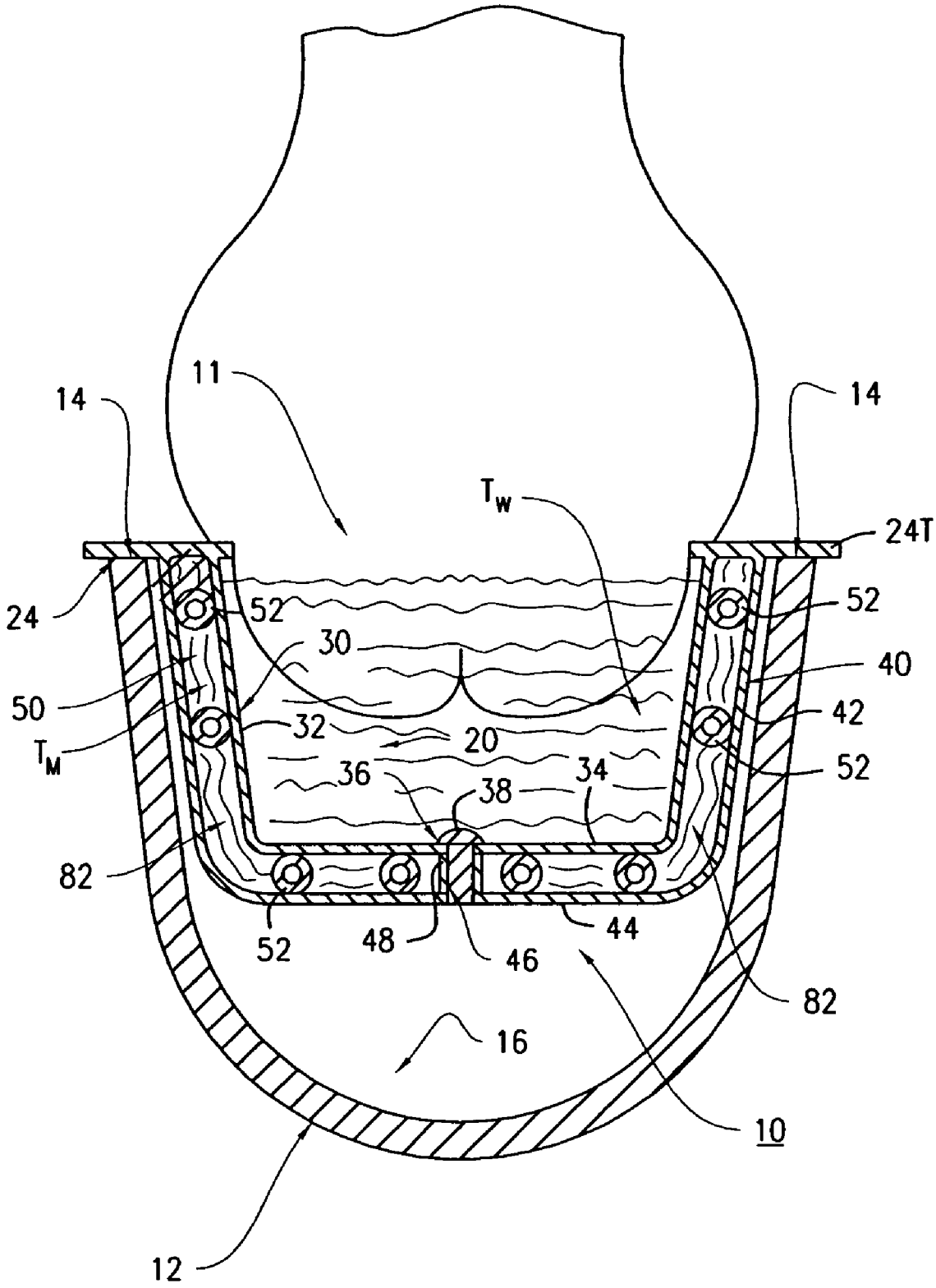
FIG. 4 is a cross-sectional view of the sitz bath/basin of the present invention taken along lines 4-4 of FIG. 1 in the direction of the arrows showing the basin in operational use on a toilet bowl with the user's buttock area submerged within the bathing compartment area for hemorrhoid treatment.
Figures 5, 6:
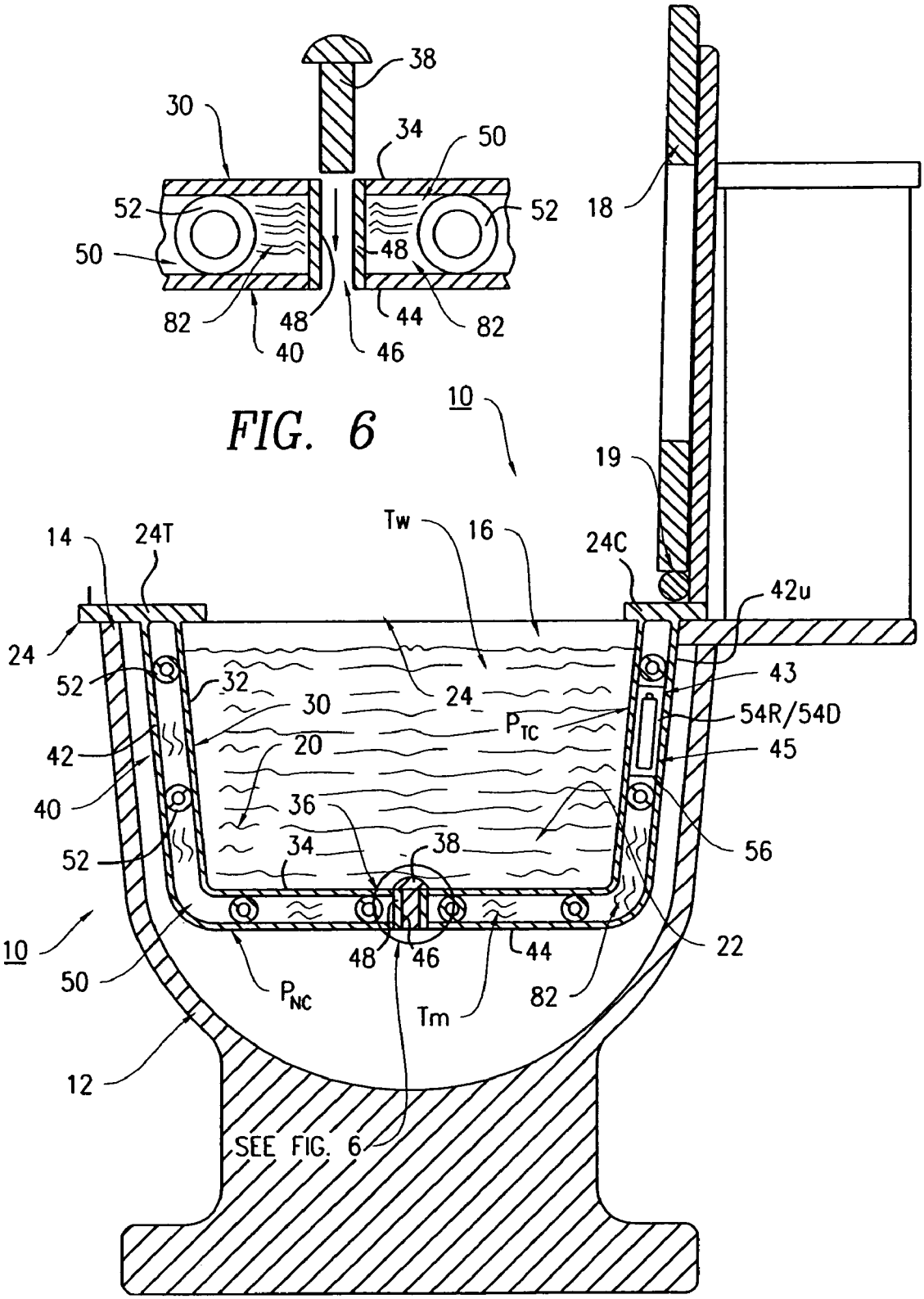
FIG. 5 is a cross-sectional view of the sitz bath/basin of the present invention taken along lines 5-5 of FIG. 1 in the direction of the arrows showing the basin being readied for operational use on the user's toilet bowl.
FIG. 6 is a sectional view of the sitz bath/basin of the present invention showing the drain openings and tube member having a drain plug therein.

The bath container 10 includes an inner shell 30 and an outer shell 40 for forming an interior compartment 50 between the inner and outer shells 30 and 40, respectively, as depicted in FIGS. 4 and 5 of the drawings. The inner shell 30 includes a circumferential side wall 32 having a concave bottom wall 34 being integrally attached thereto. The bottom wall 34 of inner shell 30 includes a centrally located drain opening 36 for draining the water 20 from the bathing compartment area 22. The outer shell 40 includes a circumferential side wall 42 having a concave bottom wall 44 being integrally attached thereto. The bottom wall 44 of the outer shell 40 includes a centrally located drain opening 46 being in alignment with drain opening 36 of inner shell 30. Drain openings 36 and 46 are connected by a tube member 48, as shown in FIG. 6, such that the water 20 in the bathing compartment area 22 can be drained completely by removing a plug 38 from drain opening 36 allowing the water 20 to drain from drain opening 36, tube member 48 and drain opening 46 into the toilet bowl opening 16 of toilet bowl 12.

Figure 7:
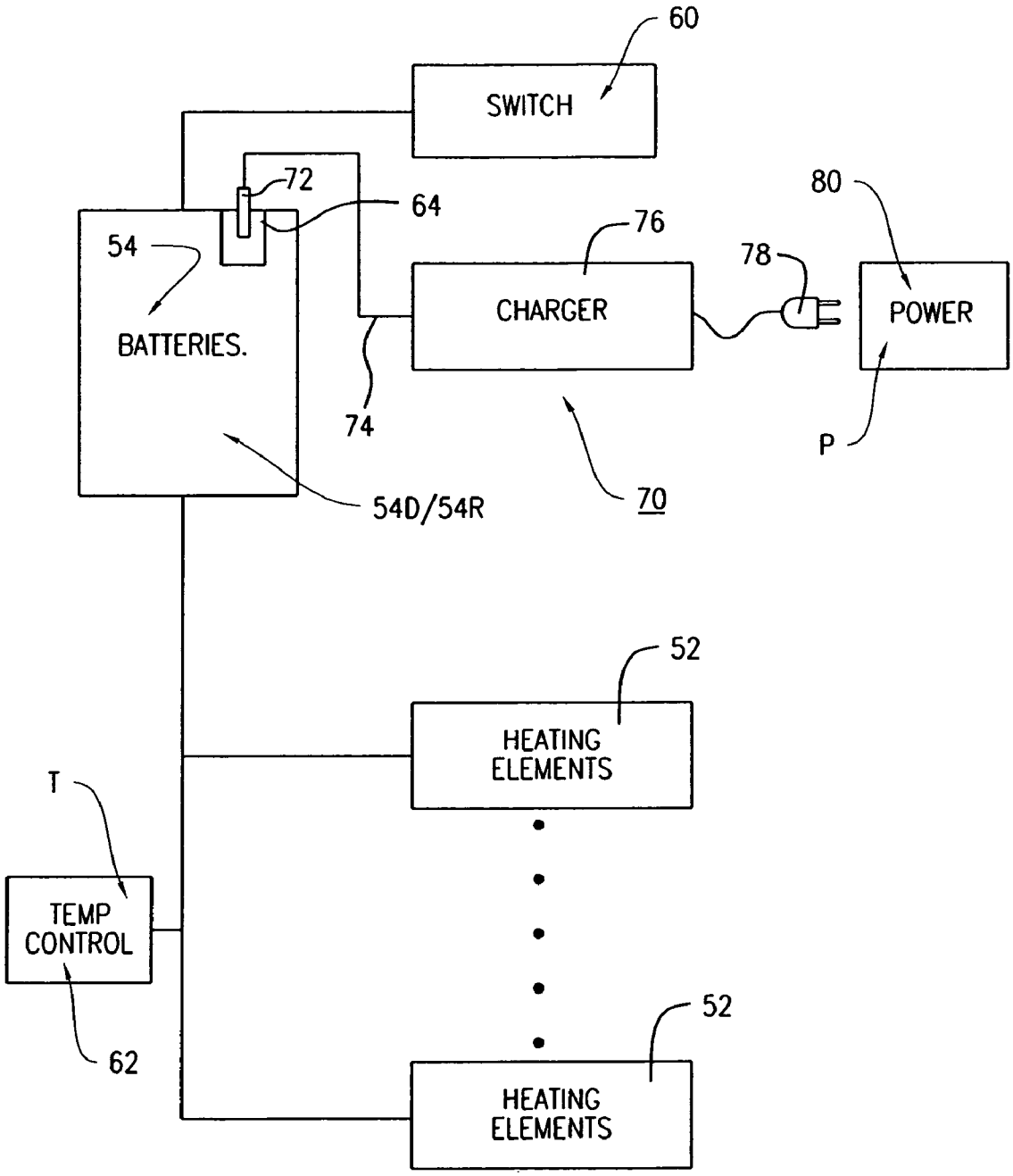
FIG. 7 is a schematic representation of the sitz bath/basin of the present invention showing the electrical connections for the basin.

The interior compartment 50 has mounted therein a plurality of spaced-apart heating coil elements 52 being disposed between the inner and outer shells 30 and 40 thereof for warming the water 20 in bathing compartment area 22 of the bath container 10. The interior compartment 50 is also used for housing one or more batteries 54 for supplying power to the heating coil elements 52. The batteries 54 are contained within a liquid-tight battery pack/compartment 56 and are electrically connected to the heating coil elements by conductive wiring 58, as depicted in FIGS. 5 and 7 of the drawings. The bath container 10 further includes a power switch 60 being connected to the heating coil elements 52 and batteries 54 for turning on and off power P to the heating coil elements 52. Batteries 54 can be rechargeable batteries 54R or disposable batteries 54D for use within battery pack 56. The battery pack 56 is located and positioned within the interior compartment 50 adjacent to the heating coil elements 52. The battery pack 56 is received within the interior compartment 50 through a battery pack opening 43 having a watertight battery pack door 45 thereon, as shown in FIGS. 1 and 5. The battery pack door 45 is located and positioned on an upper section 42*u* of the outer side wall 42 of outer shell 40. The batteries 54D (disposable) or batteries 54R (rechargeable) of battery pack 56 are electrically connected to the heating coil elements 52 for supplying power to the plurality of heating coil elements 52. Power switch 60 is located on an upper section 42*u* of the outer side wall 42 of outer shell 40, as shown in FIG. 2, and is connected to the batteries 54D or 54R and heating coil elements 52.

Additionally, the bath container 10 includes a temperature control switch 62 being connected to the heating coil elements 52 for regulating the temperature T of the heating coil elements 52 and the water 20 within the bathing compartment area 22 of bath container 10. Temperature control switch 62 is also located on the upper section 42*u* of outer side wall 42 of outer shell 40, as depicted in FIG. 2. Further, the bath container 10 includes a plug inlet receptacle 64 for receiving an electrical re-charger assembly 70 consisting of an inlet plug 72, an electrical cord 74, and a battery charger member 76 having an outlet plug 78 for connecting to a power source 80. The re-charger assembly 70 is used for re-charging the rechargeable batteries 54R within the battery pack 56, as shown in FIGS. 5 and 7 of the drawings. The plug inlet receptacle 64 is located on the upper section 42*u* of outer side wall 42 of outer shell 40.

The interior compartment 50 includes a heat transferring liquid 82 such as silicone, glycol, polypropylene, oil and the like. The inner shell 30 is made from a thermally conductive plastic material $P_{TC}$, such that the heat transferring liquid 82 conducts the heat transfer ΔT from the heating coil elements 52 through the thermally conductive plastic material $P_{TC}$ of inner shell 30 in order to maintain the warm the temperature of the bath water 20 at a proper temperature $T_W$ for the sitz bathing of the user's buttocks area in order to promote hemorrhoid healing, as depicted in FIG. 4 of the drawings. The outer shell 40 is made from a non-conductive plastic material $P_{NC}$, such that the heat transferring liquid 82 will not transfer or conduct the heat transfer ΔT from the heating coil elements 52 through the non-conductive plastic material $P_{NC}$ of outer shell 40. This retains the temperature $T_M$ of the heat transferring liquid 82 within the interior compartment 50 of the bath container 10.

In an alternate embodiment of the bath container 10, the thermally conductive plastic material $P_{TC}$ of inner shell 30 and the non-conductive plastic material $P_{NC}$ of outer shell 30 may also be a highly thermally conductive metal material $M_{TC}$, such as aluminum, steel, stainless steel and the like.

OPERATION OF THE PRESENT INVENTION

In operation, the sitz bath basin 10 operates in the following manner, as shown in FIGS. 2, 4 and 5 of the drawings. The user initially charges the batteries 54D or 54R within battery pack 56 using the recharger assembly 70, such that the user places the inlet plug 72 within the plug inlet receptacle 64 on outer shell 40, and then places the outlet plug 78 of battery charger member 76 into a standard plug outlet 80 to provide a power source P, as shown in FIG. 7. After the re-charging battery step, the user now places the empty sitz bath basin 10 within the toilet bowl opening 16 of toilet bowl 12 and mounts the upper ledge section 24T of the sitz bath basin 10 on the rim/top ledge 14 of toilet bowl 12, such that the upper ledge section 24T receives the user's buttock area 11 thereon, as shown in FIGS. 1 and 4 of the drawings. Further, the upper ledge 24 is oriented on the rim 14 of toilet bowl 12 such that the cut-out ledge section 24C is placed towards the toilet seat hinge 19, as shown in FIG. 5. The user now fills the empty bathing compartment area 22 with warm water 20. The water 20 can be a saline solution or a medication solution depending upon the therapeutic treatment needed by the user. The water 20 level should not be any higher than the patient's navel.

The user now moves the power switch 60 to an "ON" position as shown on upper wall section 42*u* of outer shell 40. Next, the user rotates the temperature control switch/knob 62 to a desired temperature level in order to heat and maintain the water 20 at a proper temperature level as needed for the therapeutic treatment indicated. The temperature control knob 62 is also located on the upper wall section 42*u* of outer shell 40. The desired water temperature is in the range of 80° F. to 115° F. for the temperature of water 20. The user should adjust the water temperature to about 110° F. and stay in the bath for twenty (20) to forty (40) minutes and then take a quick cold shower or bath.

After completion of the sitz bath 10 the user pulls the plug 38 from drain opening 36 allowing the water 20 to drain from the bathing compartment area 22 and drain opening 36 into the toilet bowl opening 16 of toilet bowl 12. The user now switches the power control switch 60 to the "OFF" position and the temperature control switch 62 to a minimum temperature setting. The empty sitz bath basin 10 is then removed from the top ledge 14 of the toilet bowl opening 16 of toilet bowl 12 and rinsed out to prepare for the user's next treatment.

ADVANTAGES OF THE PRESENT INVENTION

Accordingly, an advantage of the present invention is that it provides for a heated sitz bath/basin for the treatment and healing of hemorrhoids of a patient being adapted for mounting on the top ledge/rim of a toilet bowl opening of a toilet bowl.

Another advantage of the present invention is that it provides for a sitz bath/basin that includes an interior compartment between inner and outer shells having heating coil elements therebetween for heating of the water within the basin bathing area.

Another advantage of the present invention is that it provides for a sitz bath/basin that includes an interior compartment having a heat transferring liquid media such as silicone, glycol, oil and the like for transferring of heat ΔT from the heating coil elements to the inner shell of the sitz bath/basin and to warm the water contained therein.

Another advantage of the present invention is that it provides for a sitz bath basin that includes an inner shell made from a thermally conductive plastic material, such that the heat transferring liquid media will conduct the heat transfer ΔT from the heating coil elements through the thermally conductive plastic material of the inner shell in order to maintain the temperature of the bath water at a warm and effective temperature for bathing of the user's buttock area in order to promote hemorrhoid healing.

Another advantage of the present invention is that it provides for a sitz bath/basin that includes an outer shell made from a non-conductive plastic material, such that the transferring liquid media will not transfer or conduct the heat transfer ΔT from the heating coil elements through the non-conductive plastic material of the outer shell, such that the temperature of the transferring liquid media will be maintained within the interior compartment of the sitz basin.

Another advantage of the present invention is that it provides for a sitz bath/basin that includes a power control switch and a temperature control knob being electrically connected to the heating coil elements for regulating the temperature of the heat transferring liquid within the interior compartment, as well as the temperature of the water within the sitz basin bathing area of the sitz bath/basin.

Another advantage of the present invention is that it provides for a sitz bath/basin that includes a plug inlet receptacle for receiving an electrical recharger assembly for re-charging of rechargeable batteries or disposable batteries within a watertight battery pack.

Another advantage of the present invention is that it provides for a sitz bath/basin that is made from lightweight, durable plastic materials or metal materials.

A further advantage of the present invention is that it provides for a sitz bath/basin that can be mass-produced in an automated and economical manner and is readily affordable by the patient.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A portable, heated bath container adapted for mounting on the top ledge of a toilet bowl for the treatment of hemorrhoids, comprising:

a) a bath container being of a shape to fit within a toilet bowl opening and having a bathing area for receiving water therein;

b) said bath container having an upper ledge surrounding said bathing area for resting on the top ledge of the toilet bowl;

c) said bath container having an inner shell and an outer shell for forming an interior compartment between said inner and outer shells;

d) said interior compartment having a plurality of spaced-apart heating elements disposed therein for maintaining the water at a warm temperature in said bath container; wherein said interior compartment includes a heat transferring liquid surrounding said heating elements for the heat transfer ΔT from said heating elements to said inner wall of said bath container in order to maintain the temperature of the water in said bathing area of said bath container;

e) said interior compartment for receiving one or more batteries for supplying power to said heating elements; and f) a power switch connected to said heating elements and said batteries for turning power on and off to said heating elements.

2. A portable heated bath container in accordance with claim 1, further including a temperature control switch connected to said heating elements for regulating the temperature of said heating elements and the water in said bath container.

3. A portable heated bath container in accordance with claim 2, wherein said temperature control switch regulates the temperature of said heating elements within said heat transferring liquid and the water in said bathing area in a temperature range of 80° F. to 115° F.

4. A portable heated bath container in accordance with claim 1, wherein said one or more batteries are received within a liquid-tight battery pack.

5. A portable heated bath container in accordance with claim 4, wherein said battery pack is positioned within said interior compartment adjacent to and electrically connected to said heating elements.

6. A portable hated bath container in accordance with claim 4, wherein said battery pack is received within a battery pack opening having a liquid-tight door positioned on said outer shell of said bath container.

7. A portable heated bath container in accordance with claim 1, wherein said one or more batteries are disposable batteries.

8. A portable heated bath container in accordance with claim 1, wherein said one or more batteries are rechargeable batteries.

9. A portable heated bath container in accordance with claim 8, wherein said rechargeable batteries within said battery pack are chargeable from a plug inlet receptacle being positioned on said outer shell of said bath container.

10. A portable heated bath container in accordance with claim 9, said plug inlet receptacle for receiving an electrical recharger assembly for re-charging said rechargeable batteries within said battery pack.

11. A portable heated bath container in accordance with claim 1, wherein said inner shell is made from a thermally conductive plastic material such that said heat transferring liquid conducts the heat transfer ΔT from said heating elements through said thermally conductive plastic material of said inner shell in order to maintain the temperature $T_w$ of the water to a desired temperature for the bathing of a user's buttock area in order to promote hemorrhoid healing.

12. A portable heated bath container in accordance with claim 1, wherein said outer shell is made from a non-conductive plastic material such that said heat transferring liquid does not transfer or conduct the heat transfer ΔT from said heating elements to said non-conductive plastic material of said outer shell and thereby retains the temperature of said heat transferring liquid within said interior compartment of said bath container.

13. A portable heated bath container in accordance with claim 1, wherein said heat transferring liquid is selected from a group consisting of silicone, glycol, oil, polypropylene and combinations hereof.

14. A portable heated bath container in accordance with claim 1, wherein said inner and outer shells of said bath container are made from a thermally conductive metal material selected from a group consisting of aluminum, steel, stainless steel and the like.

15. A portable heated bath container in accordance with claim 1, wherein said upper ledge of said bath container includes an upper ledge section for receiving a toilet seat of the toilet bowl thereon.

16. A portable heated bath container in accordance with claim 1, said inner and outer shells of said bath container each include a circumferential side wall having an integrally attached bottom wall.

17. A portable heated bath container in accordance with claim 1, wherein each of said inner and outer bottom walls includes a centrally located and aligned inner and outer drain opening.

18. A portable heated bath container in accordance with claim 17, wherein said aligned inner and outer drain openings are connected by a drain tube member having a drain plug therein.

19. A portable heated bath container in accordance with claim 18, wherein said drain plug is received within said inner drain opening such that the water from said bathing area is stored therein, and said drain plug is removed from said inner drain opening such that the water in said bathing area is completely drained allowing the water to drain through said inner drain opening, said drain tube member and said outer drain opening into the toilet bowl opening of the toilet bowl.

* * * * *